United States Patent [19]

Zalar et al.

[11] Patent Number: 5,057,735

[45] Date of Patent: Oct. 15, 1991

[54] REFLECTOR LAMP UNIT WITH INDEPENDENTLY ADJUSTABLE LAMP MOUNT

[75] Inventors: Frank E. Zalar, Euclid; Richard G. Lynce, Chesterland; Vito J. Arsena, Highland Heights, all of Ohio

[73] Assignee: General Electric Company, Schenectady, N.Y.

[21] Appl. No.: 421,439

[22] Filed: Oct. 13, 1989

[51] Int. Cl.[5] ..... H01J 5/48; H01J 5/50; H01K 1/42

[52] U.S. Cl. ..... 313/318; 313/113; 313/580

[58] Field of Search ..... 313/318, 113, 580

[56] References Cited

U.S. PATENT DOCUMENTS

| | | | |
|---|---|---|---|
| 3,668,391 | 6/1972 | Kimball | 313/318 |
| 4,287,448 | 9/1981 | Bradley | 313/113 |
| 4,310,772 | 1/1982 | Tyler et al. | 313/318 X |
| 4,456,947 | 6/1984 | Alexander | 313/113 X |
| 4,623,958 | 11/1986 | Van der Linde et al. | 313/113 X |
| 4,634,920 | 1/1987 | Rijckaert et al. | 313/113 X |
| 4,728,849 | 3/1988 | Morris et al. | 313/113 |
| 4,829,210 | 5/1989 | Benson et al. | 313/318 |

*Primary Examiner*—Donald J. Yusko
*Assistant Examiner*—Brian Zimmerman
*Attorney, Agent, or Firm*—George E. Hawranko; Stanley C. Corwin; Fred Jacob

[57] ABSTRACT

A simplified lamp mount structure for a reflector lamp unit is disclosed enabling improved automated assembly on existing manufacturing equipment. The lamp mount arrangement physically supports a tungsten-halogen lamp entirely with electrical conductors protruding from the lamp envelope and secured to refractory closure means located at the bottom portion of a reflector member. Various lamp unit embodiments employing such modified lamp mounts are also described.

12 Claims, 2 Drawing Sheets

REFLECTOR LAMP UNIT WITH INDEPENDENTLY ADJUSTABLE LAMP MOUNT

RELATED PATENT APPLICATIONS

A copending application Ser. No. 331,154, filed Mar. 31, 1989, now U.S. Pat. No. 4,959,583 and assigned to the same assignee as the present invention discloses a related lamp mount arrangement for a reflector type lamp unit to improve resistance of the overall lamp unit to mechanical shock and vibration. The described mount construction employs external clamp means and post members secured to the lamp for this purpose. Another commonly assigned application Ser. No. 421,447, filed concurrently with the present application, discloses a further related reflector lamp unit.

BACKGROUND OF THE INVENTION

This invention relates generally to improved construction of a reflector lamp unit employing a tungsten-halogen lamp for its light source, and more particularly to a simpler mount construction for the lamp member in said type lamp unit to enable improved automated assembly.

Parabolic aluminized reflector (PAR) lamps and lesser efficient, with regard to quality of the light beam control, as represented by reflector (R) lamps are already well known for general spot or floodlighting applications. Such lamp units commonly employ a tungsten-halogen lamp for the light source which is mounted within the internal reflector cavity approximately at its optical focal point. Various lamp mounting arrangements in this type lamp unit are also well known which must withstand mechanical shock and vibration both during lamp manufacture and subsequent lamp service. Such an objective has frequently required the lamp mounting arrangement to include auxiliary support means secured to the lamp member, such as disclosed in the above referenced copending Ser. No. 331,154, now U.S. Pat. No. 4,959,583 application. A similar lamp mounting construction is also disclosed in commonly assigned U.S. Pat. No. 4,743,803 for a general service incandescent type lamp unit employing a conventional metal screw base. In said latter type mount construction, the improved vibration resistance is also attributed to post and clamp means being affixed to the lamp member. The particular type tungsten-halogen lamp construction being utilized in both of said known lamp mounting arrangements suspends the tungsten filament between a single pair of refractory metal electrical conductors which further protrude from one end of the lamp envelope.

A reflector lamp unit is desired having a modified structural configuration more compatible with existing high speed automated manufacture. In doing so it becomes desirable to further simplify the lamp mounting arrangement while still maintaining shock and vibration resistance for the assembled lamp unit. It becomes still further desirable to modify the lamp mount construction in such a manner that precise positioning of the light source at the optical focal point of the reflector member is also enhanced.

It is one object of the present invention, therefore, to simplify the lamp mount configuration for a reflector type lamp unit.

It is a further object of the present invention to facilitate assembly of such improved reflector type lamp unit with existing automated manufacturing equipment.

A still further object of the present invention is to provide improved means for spatially positioning the lamp member in a reflector type lamp unit with cooperation of the lamp mounting means.

These and still further objects of the present invention will become apparent upon considering the following detailed description for the present invention.

SUMMARY OF THE INVENTION

Simpler structural means to physically support a tungsten-halogen lamp in a reflector lamp unit have now been discovered. Electrically non-conductive refractory closure means cooperate to precisely position said lamp member at the reflector optical focal point. Said closure means is secured to a central opening provided in the bottom portion of the reflector member with an electrically non-conductive refractory cement. A typical reflector lamp unit constructed in the presently improved manner comprises (a) a reflector having an internal reflective surface and a longitudinally extending bottom portion affixed to an electrically conductive screw base, the reflector bottom portion terminating at its lower end in a central opening, (b) a tungsten-halogen lamp disposed within the reflector cavity having an elongated sealed envelope of light transmissive material containing an inert gas fill and a halogen substance together with a tungsten filament being suspended therein from a first pair of refractory metal electrical conductors, and a second pair of larger diameter electrical conductors exhibiting greater thermal expansion characteristics being joined to the opposite end of each refractory metal electrical conductor in a pinch seal region of the envelope with the opposite end of the larger diameter electrical conductors both protruding from the sealed end of said envelope to provide entire physical support of the lamp, (c) electrically non-conductive refractory closure means affixed to the central opening of the reflector bottom portion which include a closure member of electrically non-conductive refractory inorganic material having physical dimensions and a shape larger than the central opening together with an electrically non-conductive refractory inorganic cement bonding the closure member to the central opening, the closure member further having at least one pair of openings accommodating passage of the protruding electrical conductors therethrough, (d) means for electrically connecting both protruding electrical conductors to the screw base, and (e) means which cooperate with the closure member to position the filament of the tungsten-halogen lamp approximately at the focal point of the reflector. Suitable tungsten-halogen lamp constructions further include filament alignment being substantially along the central or longitudinal lamp unit axis as well as being substantially transverse thereto. A reflector lamp unit of this type generally further includes a lens element being affixed at the top portion of the reflector. In one embodiment, the top surface of the closure member is spaced apart from the mounted lamp member with spacer means affixed to the lamp envelope as the means to position the tungsten filament of the lamp within the reflector cavity. In a different embodiment, the pair of electrical conductors protruding from the lamp envelope are provided with structural bends which physically contact the top surface of said closure means and serve as the means positioning the tungsten filament of the lamp within the reflector.

In one preferred embodiment, the presently improved reflector lamp unit comprises (a) a pressed glass reflector having a parabolic shaped internal electrically conductive reflective surface and a longitudinally extending conically shaped bottom portion affixed to an electrically conductive hollow metal screw base shell, the bottom reflector portion terminating at its lower end in a central opening, (b) a tungsten-halogen lamp disposed within the reflector having an elongated sealed aluminosilicate glass envelope which contains a fill at superatmospheric pressure of at least one rare gas and a vaporizable halogen compound together with a coiled tungsten filament being suspended therein from a first pair of refractory metal electrical conductors, and a second pair of larger diameter electrical conductors exhibiting greater thermal expansion characteristics being joined to the opposite end of each refractory metal conductor in a pinch seal region of the envelope with the opposite end of the larger diameter electrical conductors protruding from the same end of said envelope to provide the entire physical support for the lamp, (c) electrically non-conductive refractory closure means affixed to the central opening of the reflector bottom portion which include a disc shaped member having a larger diameter than the central opening together with an electrically non-conductive refractory inorganic cement bonding the bottom portion of said disc member to the central opening, the closure member further including a pair of openings accommodating passage of the protruding electrical conductors therethrough together with additional exhaust openings, (d) conductor means for electrically connecting both protruding electrical conductors to the metal base shell, and (e) means which cooperate with the closure member to position the coiled filament of the tungsten-halogen lamp approximately at the optical focal point of the reflector. Modification of the parabolic reflector cavity to provide a concave elliptical contour in said preferred lamp unit embodiment is also contemplated. Conventional inorganic glass and ceramic compositions can be selected for the closure means so long as electrically non-conductive as well as thermally resistant to the wall temperatures of 200° C. and higher which are normally experienced when such lamp units are being operated.

DETAILED DESCRIPTION OF THE PREFERRED EMBODIMENTS

Figure 1:
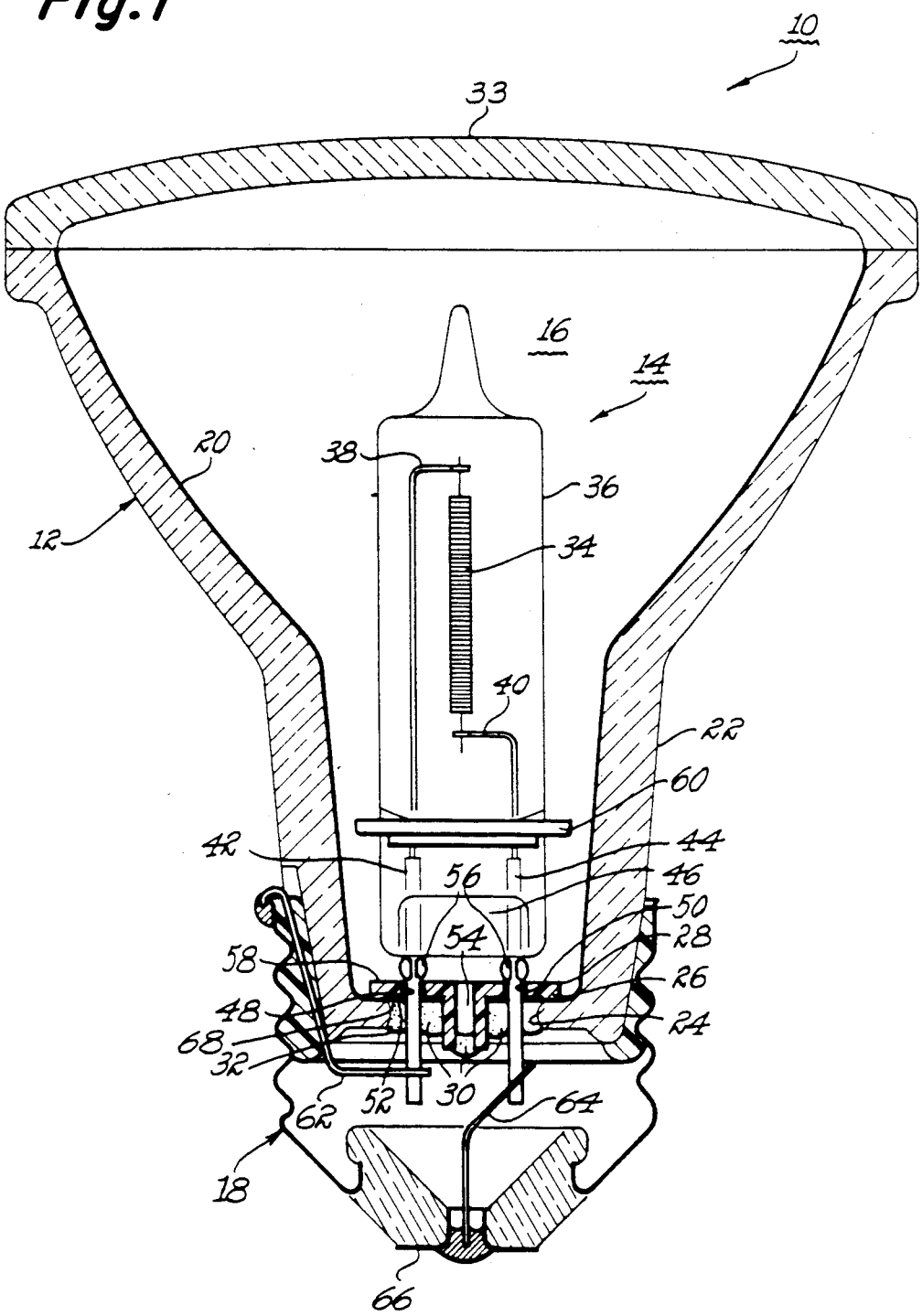
FIG. 1 is a side view illustrating one embodiment for a PAR type lamp unit according to the present invention

Referring to the drawings, there is depicted in FIG. 1 an improved reflector lamp unit 10 having a PAR 20 size configuration in accordance with one embodiment of the present invention. The lamp unit 10 includes a pressed glass reflector 12 having a tungsten-halogen lamp 14 disposed within its internal cavity 16 (as hereinafter further defined) and being affixed to a conventional metal screw base 18. Reflector 12 has an internal reflective parabolic surface 20 which can be typically silver, aluminum or dichroic type, and a bottom portion 22 having a longitudinally extending conical configuration as shown. Bottom reflector portion 22 can be secured to the metal base shell 18 in a conventional manner such as by adhesive joinder with a suitable epoxy cement. As can also be seen in the drawing, bottom reflector portion 22 terminates at its lower end in a central opening 24 which is occupied by a reflector closure means 26 being affixed thereto. Said refractory closure 26 physically supports the tungsten-halogen lamp 14 with a refractory closure member 28 having physical dimensions and a shape larger than central opening 24 and which is bonded to said central opening with a refractory cement 30. As seen in FIG. 1, the closure member 28 is of such a size relative to the central opening 24 so as to allow adjustment of the closure number 28 in the lateral direction to achieve the optical focal point of the lamp unit 10. As previously mentioned, both components of said refractory closure means can be formed with conventional inorganic glass and ceramic compositions. Accordingly, alumina, zirconia and glass can be selected to form closure member 28 while the electrically insulating inorganic cement disclosed in the above referenced Ser. No. 331,154 copending application has been found suitable for adhesively bonding said closure member to the pressed glass reflector member. It becomes further possible to coat the underside or bottom surface 32 of said representative refractory closure means with a conventional sealing agent when hermetic sealing of the entire reflector cavity is desired for particular lamp applications. As can also be seen in the drawing, reflector cavity 16 is further closed at its top end with a conventional lens element 33.

Representative tungsten-halogen lamp 14 includes an axially aligned tungsten coil filament 34 being hermetically sealed within an elongated aluminosilicate glass envelope 36 so as to have the center of the tungsten coil reside approximately at the focal point of reflector 12. Filament coil 34 is physically suspended within the lamp envelope 36 by a composite assembly of "lead wire" type electrical conductors 38, 40, 42 and 44. More particularly, such cooperating lead wire construction employs a first pair of electrical conductors 38 and 40 connected at one end to respective ends of the lamp filament coil 34 while being individually connected at the opposite ends to larger diameter electrical conductors 42 and 44 in the stem press region 46 of lamp envelope 36. For the particular size lamp embodiment being illustrated, suitable inner electrical conductors 38 and 40 can be formed with approximately 12–30 mils diameter molybdenum alloy whereas suitable outer protruding electrical conductors 42 and 44 can be formed with an electrically conductive metal having greater thermal expansion characteristics, such as nickel plated iron or nickel iron alloy, at approximately 35–60 mils diameter. The depicted lamp envelope 36 further includes a gaseous fill (not shown) which contains at least one rare gas and a vaporizable halogen substance such as an alkyl halide compound.

In accordance with the present invention, the physical suspension of tungsten-halogen lamp 14 within reflector cavity 16 is provided by refractory closure means 26 and is done so in a manner enabling said closure means to further cooperate in spatially positioning the center of the lamp filament coil to reside approximately at the optical focal point in said reflector cavity. The lamp suspension is carried out by having its protruding electrical conductors 42 and 44 extend through a pair of openings 48 and 50 provided in the refractory closure member 28 while being secured in said openings with the refractory cement 30 also being employed. A better retention of conventionally applied liquid cement formulations for this purpose, until dried or cured in the conventional manner, is provided in the depicted closure member 28 with a reservoir cavity or indent 52 further being included therein. As also seen in the drawing, such closure member still further includes an exhaust opening 54 for customary evacuation of the reflector cavity 16. Proper spatial disposition for the physically suspended lamp 14 within reflector cavity 16 is provided with bends or upsets 56 having been formed in the protruding electrical conductors 42 and 44 during lamp assembly so as to physically contact top surface 58 of the refractory closure member 28. As also shown in the drawing, a conventional metal heat shield member 60 has been threaded over the bent protruding electrical conductors during such lamp assembly procedure. Conductor means 62 and 64 are further provided to electrically connect the protruding lower ends of said electrical conductors to the conventional type screw base member 18. Such electrical interconnection of protruding electrical conductor 42 to the side of the metal base shell is provided with conductor 62, whereas remaining protruding conductor 44 is interconnected to a center eyelet 66 of said metal base shell with conductor 64. The desired interconnection can be provided by conventional metal fastening means such as soldering, welding or staking, and it is contemplated that the parameters selected for conductor 64 can serve as a fuse element.

Fully automated manufacture of the above illustrated reflector lamp unit can be carried out with conventional lamp assembly equipment. In doing so, the protruding electrical conductors 42 and 44 are first bent at the desired location for placement of the lamp filament coil 34 relative to reflector cavity 16 and the heat shield member 60 next assembled to the bent conductors for placement in the stem press region of the lamp envelope. Refractory closure member 28 is next assembled to the bent conductors to form the mounted lamp assembly which is then fitted through the central opening 24 provided in reflector bottom portion 22 and physically held secured thereto at the reflector focal point. Deposition and drying or curing of refractory cement 30 at the bottom surface 68 of refractory closure member 28 secures the protruding electrical conductors 42 and 44 in place while adhesively bonding the entire lamp mounting arrangement to the reflector member. Customary evacuation of reflector cavity 16 thereafter proceeds by means of an exhaust opening 54 provided in the illustrated refractory closure member after said reflector cavity has been completely enclosed by affixing the top lens element 33 thereto. Optional coating of the bottom surface 32 of said fully assembled refractory closure means with a conventional sealing agent (not shown), such as with a silicone or other thermally resistant organic adhesive can provide hermetic sealing of the reflector cavity when desired. The top surface 58 of said assembled refractory closure means also remains devoid of any electrically conductive reflective surface in order to retain electrical isolation of the lamp conductors joined thereto. Conductors 62 and 64 are next secured at the lower ends of the protruding electrical conductors by such conventional means as soldering or welding. Final assembly of the illustrated lamp unit thereafter only further requires that conductors 62 and 64 be similarly secured to the metal screw base shell 18 and that said base shell be suitably joined to bottom reflector portion 22 such as with epoxy cement.

Figure 2:
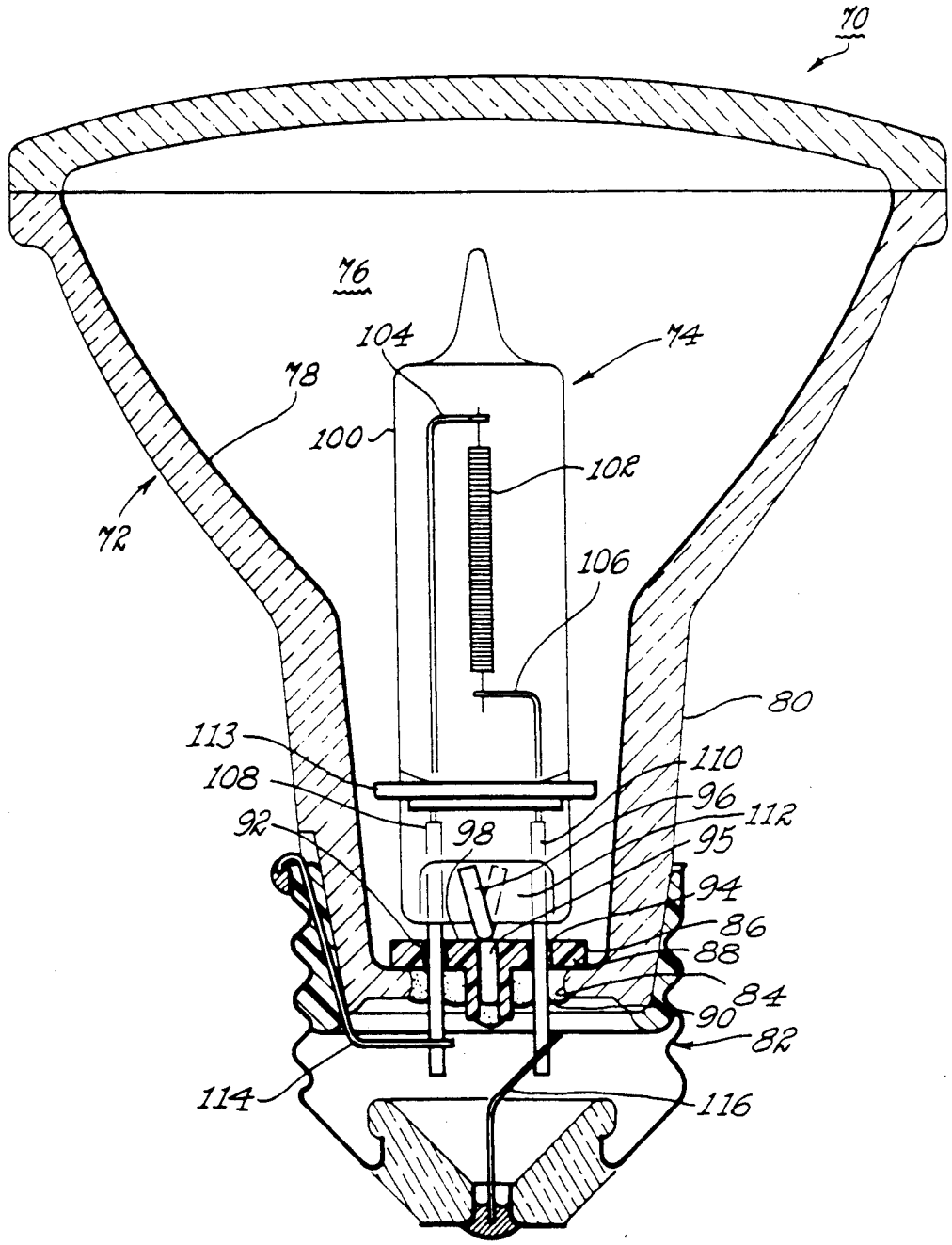
FIG. 2 is a side view depicting a different embodiment for a typical PAR type lamp unit according to the present invention.

FIG. 2 depicts a different representative lamp unit embodiment having spacer means affixed to the bottom of the lamp envelope which physically contact the top surface of the refractory closure member and thereby provide the desired spatial orientation for the mounted lamp member within the reflector cavity. Accordingly, the herein improved reflector lamp unit 70 having a PAR 30 size configuration includes reflector 72 with a tungsten-halogen lamp 74 being disposed within the internal cavity 76. Similarly, reflector 72 has an internal reflective parabolic surface 78 and a longitudinally extending bottom portion 80 which is secured to a conventional metal screw base shell 82. Likewise, reflector bottom portion 80 terminates at its lower end in a central opening 84 again occupied with refractory closure means 86. Said refractory closure means includes a refractory closure member 88 adhesively bonded to the central opening with cement 90, as hereinbefore defined and with the depicted refractory closure member again having a pair of openings 92 and 94 in which the protruding lamp conductors are secured as well as having an exhaust opening 95. The mounted tungsten-halogen lamp 74 includes a metal clip 96 secured to the bottom of the lamp envelope and which protrudes downwardly therefrom to physically contact top surface 98 of the refractory closure member. The illustrated spacer element 96 can have a U shaped contour for ease of automated physical attachment to the lamp envelope and provides the structural means for positioning the mounted lamp member at the optical focal point in the reflector cavity. For such cooperative action, the presently illustrated tungsten-halogen lamp again requires a sealed lamp envelope 100 containing a tungsten filament 102 suspended between refractory metal conductors 104 and 106 which are joined at the outer ends to larger diameter electrical conductors 108 and 110 in a press seal region 112 of the lamp envelope. Lamp envelope 100 again further contains an inert gas fill and a halogen substance (not shown). A thermal shield 113 is again disposed intermediate the suspended lamp 74 and the refractory closure means 86 in the presently depicted embodiment while electrical interconnection of the protruding lamp conductors 108 and 110 to the metal base shell 82 is again provided with respective conductors elements 114 and 116.

Automated assembly of the herein illustrated reflector lamp unit 70 first joins spacer element 96 to lamp envelope 100 while further joining the heat shield member 113 thereto in the press seal region 112. Refractory closure member 88 is then threaded over the protruding ends of lamp conductors 108 and 110 until top surface 98 of the closure member engages the spacer element. The physically assembled lamp mount construction is next fitted through central opening 84 in the reflector bottom portion and securely held in place at the reflector focal point. The physically assembled arrangement is next permanently secured together with cement 90. Further completion of the assembly procedure for the present embodiment can then proceed in the previously described manner.

It will be apparent from the foregoing description that a generally improved reflector lamp unit has been provided enabling assembly more readily with existing automated manufacturing equipment. It is contemplated that modifications can be made in the lamp embodiments herein illustrated, however, without departing from the spirit and scope of the present invention. For example, the parabolic reflecting surface of the reflector member herein illustrated can be provided with other already known contours while the reflective surface can be provided with stippling or a diffuse reflective coating as well as other known multifaceted reflective configurations. Similarly, the present tungsten-halogen lamp construction can include various tungsten filaments sized and shaped for the particular wattage and voltage requirements of the intended lamp applications. The desired cooperation of the refractory closure member in properly locating the supported lamp member within the reflector cavity might also be achieved with upwardly extending relief projections being provided on the top surface of said closure member. Accordingly, it is intended to limit the present invention only by the scope of the appended claims.

What we claim as new and desire to secure by Letters Patent of the United States is:

1. A reflector lamp unit comprising:

(a) a reflector having an internal electrically conductive reflective surface and a longitudinally extending bottom portion affixed to an electrically conductive screw base, the reflector bottom portion terminating at its lower end in a central opening, (b) a tungsten-halogen lamp disposed within the reflector having an elongated sealed envelope of light transmissive material containing an inert gas fill and a halogen substance together with a tungsten filament being suspended therein from a first pair of refractory metal electrical conductors, and a second pair of larger diameter electrical conductors exhibiting thermal expansion characteristics greater than said first pair of electrical conductors and being joined to respective opposite ends of each of said first pair of refractory metal electrical conductors in a pinch seal region of the envelope with respective opposite ends of the larger diameter electrical conductors both protruding from the sealed end of said envelope such that substantially all physical support of the lamp is provided thereby, (c) electrically non-conductive refractory closure means affixed to the central opening of the reflector bottom portion which include a closure member of electrically non-conductive refractory inorganic material having physical dimensions and a shape larger than the central opening together with an electrically non-conductive refractory inorganic cement bonding the closure member to the central opening, the closure member further having at least one pair of openings accommodating passage of the electrical conductors which protrude therethrough, (d) means for electrically connecting both electrical conductors to the screw base, and (e) positioning means which cooperate with the closure member to position the filament of the tungsten-halogen lamp approximately at the optical focal point of the reflector, said positioning means and said closure member being adjustable independently of each other.

2. A reflector lamp unit according to claim 1 further including a lens element affixed to the top portion of the reflector.

3. A reflector lamp unit according to claim 1 wherein the closure member comprises a ceramic disc.

4. A reflector lamp unit according to claim 1 wherein the closure member includes additional exhaust openings.

5. A reflector lamp unit according to claim 1 wherein spacer means are affixed to the lamp envelope which physically contact the refractory closure member and which together serve as the means to position the tungsten filament within the reflector.

6. A reflector lamp unit according to claim 1 wherein the electrical conductors which protrude through said closure member are provided with respective bendable portions which come in physical contact with the closure member as the means to position the tungsten filament within the reflector.

7. A reflector lamp unit as in claim 1 which further includes heat shield means interposed between the lamp and closure means.

8. A reflector lamp unit as in claim 1 wherein the top surface of the closure member is devoid of any electrically conductive reflective surface.

9. A reflector lamp unit as in claim 1 wherein a lower surface of the closure member includes a reservoir cavity accommodating said inorganic cement.

10. A reflector lamp unit according to claim 1 wherein the closure member has a bottom surface which is coated with a hermetic sealing material.

11. A reflector lamp unit comprising:

(a) a pressed glass reflector having a parabolic shaped internal electrically conductive reflective surface and a longitudinally extending conically shaped bottom portion affixed to an electrically conductive hollow metal screw base shell, the reflector bottom portion terminating at its lower end in a central opening said reflector having an optical focal point, (b) a tungsten-halogen lamp disposed within the reflector having an elongated sealed aluminosilicate glass envelope which contains a fill at superatmospheric pressure of at least one rare gas and a vaporizable halogen compound together with a coiled tungsten filament being suspended therein from a first pair of refractory metal electrical conductors, and a second pair of larger diameter electrical conductors exhibiting thermal expansion characteristics greater than said first pair of electrical conductors and being joined to respective opposite ends of each of said first pair of refractory metal conductors in a pinch seal region of the envelope with respective opposite ends of the larger diameter electrical conductors protruding from the pinch sealed region of said envelope such that substantially all physical support of the lamp is provided thereby, (c) electrically non-conductive refractory closure means affixed to the central opening of the reflector bottom portion which include a disc shaped member having a top and a bottom portion and being made of electrically non-conductive refractory inorganic material and having a larger diameter than the central opening together with an electrically non-conductive refractory inorganic cement bonding the bottom surface of said disc member to the central opening, the disc member further including a pair of openings accommodating passage of the electrical conductors therethrough together with additional exhaust openings, (d) conductor means for electrically connecting both electrical conductors which protrude through said closure member to the metal screw base shell, and (e) positioning means which cooperate with the closure member to position the coiled tungsten filament of the tungsten-halogen lamp approximately at the optical focal point of the reflector, said positioning means being adjustable independently of said closure member.

12. A reflector lamp unit according to claim 11 wherein said positioning means is adjustable along an axis transverse to the longitudinal axis of said reflector lamp unit.

* * * * *